US007419216B2

(12) United States Patent
Hunziker

(10) Patent No.: US 7,419,216 B2
(45) Date of Patent: Sep. 2, 2008

(54) SEAT BACK UNIT FOR A CHAIR, IN PARTICULAR FOR A WHEELCHAIR OR A STAND-UP WHEELCHAIR

(75) Inventor: Kurt Hunziker, Steffisburg (CH)

(73) Assignee: Degonda Rehab SA, Lausanne (CH)

( * ) Notice: Subject to any disclaimer, the term of this patent is extended or adjusted under 35 U.S.C. 154(b) by 32 days.

(21) Appl. No.: 11/545,466

(22) Filed: Oct. 10, 2006

(65) Prior Publication Data

US 2007/0085396 A1 Apr. 19, 2007

(30) Foreign Application Priority Data

Oct. 10, 2005 (CH) ..... 1628/05

(51) Int. Cl.
*A47C 1/024* (2006.01)
*A47C 7/54* (2006.01)

(52) U.S. Cl. ..... 297/330; 297/354.1; 297/354.12; 297/358; 297/362.11; 297/411.39; 297/DIG. 4

(58) Field of Classification Search ..... 297/358, 297/330, DIG. 4, 362.11, 411.39, 354.1, 297/354.12
See application file for complete search history.

(56) References Cited

U.S. PATENT DOCUMENTS 3,025,108 A * 3/1962 Teague, Jr. ..... 297/330 X
3,414,324 A * 12/1968 Taylor et al. ..... 297/330 X
3,486,789 A * 12/1969 Cahlik et al. ..... 297/330 X
3,578,379 A * 5/1971 Taylor et al. ..... 297/330 X
3,630,569 A 12/1971 Lory
4,390,076 A * 6/1983 Wier et al. ..... 297/330 X
4,632,450 A * 12/1986 Holdt ..... 297/330 X
4,722,566 A * 2/1988 Castellini ..... 297/330 X
4,968,095 A * 11/1990 Moyer ..... 297/411.39
4,978,170 A * 12/1990 Pelz et al. ..... 297/411.39
5,181,762 A * 1/1993 Beumer ..... 297/358
5,267,778 A * 12/1993 Krebs et al. ..... 297/330

(Continued)

FOREIGN PATENT DOCUMENTS

EP 0 960 614 12/1999

*Primary Examiner*—Rodney B. White
(74) *Attorney, Agent, or Firm*—Morriss O'Bryant Compagni, P.C.

(57) ABSTRACT

The seat back unit has a seat back frame which can be tilted around the tilting axis (11) of the support (21). Movable on the seat back frame (13) is the seat back (25). A linear motor (33) serves to incline the seat back frame (13) together with the seat back (25). With a linear motor (33) the distance between the support (21) and the connecting section (17) of the back frame (13) can be reduced or increased, respectively. A tape (43) extends from a stationary part (45) of the linear motor (33) via the connecting section (17) to the seat back carrier (44). Accordingly, if the seat back frame (13) is tilted towards the rear, the seat back (25) is moved downward together with the arm rests (29) attached to the seat back carrier (44). A stabilizing mechanism (51) keeps the arm rest (29) in a practically horizontal position. Accordingly, on reclining the arms of the user remain always in a practically horizontal position and are finally lowered to a position practically parallel to the body. Therefore there will be never a danger of the arms gliding down from the arm rests (29), so that also a strongly invalid user of the wheelchair will always be in a position to control the control lever (30).

17 Claims, 3 Drawing Sheets

U.S. PATENT DOCUMENTS 5,366,036 A 11/1994 Perry
5,634,688 A 6/1997 Ellis
5,645,313 A * 7/1997 Best et al. ..... 297/330 X
5,984,408 A * 11/1999 Bujaryn ..... 297/411.39 X
6,079,787 A * 6/2000 Nichols et al. ..... 297/411.39
6,158,810 A 12/2000 Galloway
6,212,713 B1 4/2001 Kuck
6,361,114 B1 * 3/2002 Rumler ..... 297/411.39
6,425,635 B1 * 7/2002 Pulver ..... 297/330 X
6,533,353 B2 * 3/2003 Johnston ..... 297/330
6,715,836 B1 * 4/2004 Chen et al. ..... 297/411.39
7,125,080 B1 * 10/2006 Jarema et al. ..... 297/411.39 X
7,296,856 B2 * 11/2007 Rozaieski et al. ..... 297/358 X
2005/0088024 A1 4/2005 Rozaieski

* cited by examiner

SEAT BACK UNIT FOR A CHAIR, IN PARTICULAR FOR A WHEELCHAIR OR A STAND-UP WHEELCHAIR

This application claims priority to Swiss Patent Application No. 01628/05 filed on Oct. 10, 2005, the entirety of which is incorporated by reference.

BACKGROUND OF THE INVENTION

The present invention refers to a seat back unit for a chair, in particular a wheelchair or a stand-up wheelchair.

Chairs on which the seat back can be tilted into lying position are known already for a long time. Many of these chairs have the disadvantage that on tilting of the seat back a relative motion takes place between the back of the user and the seat back causing a so called shirt-pulling effect. In order to avoid this the U.S. Pat. No. 3,630,569 proposes a mechanism which, when the seat back is tilted rearward, moves the seat back also somewhat in direction toward the tilting axis. The chair has an arm rest which is rigidly connected to the seat back. This has the disadvantage that in lying position of the user the arm rest is extending vertically upward.

There exist wheel chairs and stand-up wheel chairs having means to prevent undesirable relative motions between the user and the surfaces of the chair. The stand-up wheelchair according to U.S. Pat. No. 5,366,036 comprises a seat back frame capable of being tilted around a tilting axis. Arm rests are pivotally connected to the seat back frame. Means are provided which on standing up or on reclining the seat back to the rear move the seat back down in direction of the tilting axis, so that no shirt-pulling effect occurs. A disadvantage of this stand-up wheelchair is that in lying position the arm rests extend vertically upward, so that many invalid users will not anymore be in position to operate the controls and will require help.

The European Patent No. EP 0 960 614 discloses a chair having a seat back provided on both sides with a bracket pivotally connected to a plate of the seat frame. The arm rests are pivotally connected to the seat back by means of a U-formed support. A stud is provided at the bottom the U-formed support. This stud engages a curved slot in the plate of the seat frame. By means of a linear motor being coupled by a linkage to both brackets of the seat back the seat back can be tilted. When the seat back is tilted also the arm rests will be tilted. The curved slot controlling the tilting of the arm rests is such arranged that e.g. on an inclination of the seat back by 60 degrees the arm rests will only be tilted by 30 degrees (FIG. 5). This chair has the disadvantage that the arm rests are not kept in practically horizontal position when the seat back is inclined. Of further disadvantage is that the chair does not permit a lateral transfer movement of the user from the chair into the bed, or vice versa, because the U-formed support with the arm rest forms an obstruction. It is also of disadvantage that on an inclination of the seat back no movement of the seat back with respect to the tilting axis takes place. Therefore, to avoid a shirt-pulling effect, the pivotal connection between the seat back and the seat frame must be located near the hip joint of the user of the chair to prevent the shirt-pulling effect. Also this causes an obstruction.

SUMMARY OF THE INVENTION

It is an object of the present invention to provide a seat back unit which assures that in every position the arms of the user remain comfortably located on the arm rests. The user should remain capable to operate the controls with ease in every position, also in the horizontal position of the seat back. The seat back unit should have no obstacles impeding or inhibiting a lateral transfer of the user of the chair.

These objects are obtained by a seat back unit comprising a seat back frame capable of being tilted around a tilting axis, a seat back up and down glideably mounted on the seat back frame, arm rests pivotally attached to the seat back, means which on backward tilting of the seat back frame move the seat back downward, and actuator for changing the inclination of the seat back frame, a stabilizing mechanism for keeping the arm rests substantially horizontally independently of the inclination of the seat back frame. This seat back unit has the advantage that the stabilizing mechanism keeps the arm rests in practically horizontal position independent of the degree of inclination of the seat back. If the user desires, the arm rests may also have a small inclination. Because the arm rests are connected to the seat back they are also moved downward when the seat back is inclined backward. Accordingly, in lying position the arms of the user extend practically parallel to his body. In no position of the seat back there is a danger that the arms of the user may glide from the arm rests. Therefore there is no danger that the user, depending on his invalidity, may not be any more in a position to operate the controls. A further advantage of the seat back unit consists in that it does not require a support of the arm rests impeding the transfer of the user of the chair.

Preferably, the seat back unit comprises two parallel columns pivotally connected to a support. The seat back comprises on each side guiding means for gliding along the respective column. The actuator for changing the inclination, e.g. a linear motor, is connected to the support and to a section of the seat back frame connecting the parallel columns on the top. Operating of the linear motor causes the distance between the support and the section connecting the parallel columns to be decreased or increased so that the inclination of the seat back is increased or decreased.

DETAILED DESCRIPTION OF THE INVENTION

Figure 2:
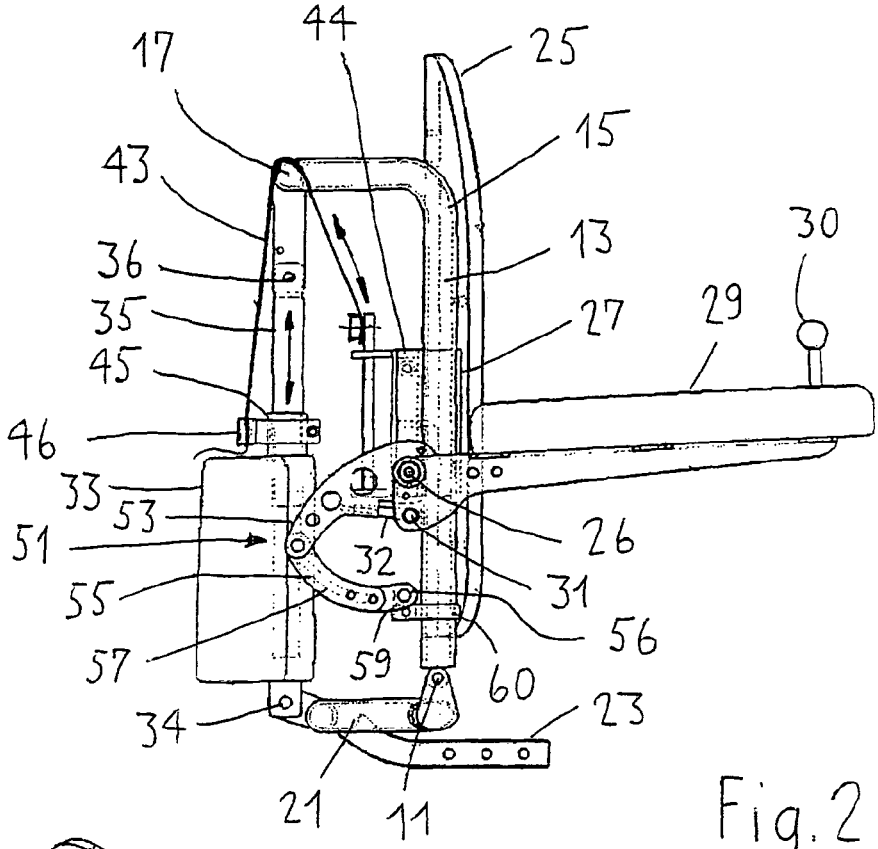
FIG. 2 shows a side elevation of the seat back unit of FIG. 1.
Figure 1:
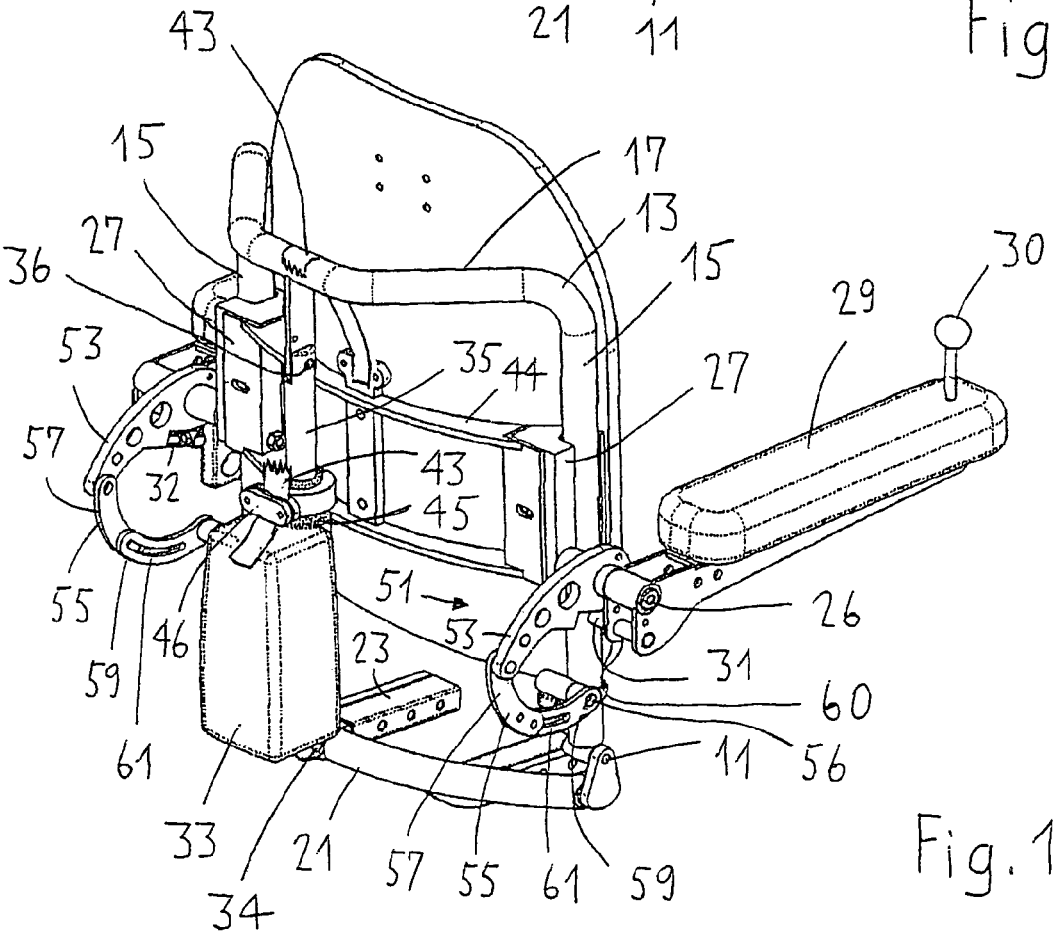
FIG. 1 shows a perspective view of the seat back unit.

The seat back unit shown in FIGS. 1 and 2 comprises a seat back frame 13 capable of being tilted around the tilting axis 11. The seat back frame 13 has two columns 15 arranged parallel to each other and being connected by a connecting section 17. Preferably, the seat back frame 13 is made of a single piece of tubing. The columns 15 of the seat back frame 13 are with their lower end connected to the support 21 which has a connector arm 23 for mounting the seat back unit to a chair. However, it would also be possible to connect the seat back frame 13 directly to the chair. The seat back 25 has on each side a guiding portion 27 partly enclosing the pertaining column 15. Accordingly, the seat back 25 is glidingly movable in the seat back frame.

The arm rests 29 are pivotally connected to the seat back frame 25 at 26. They are kept in the position shown in FIGS. 1 and 2 by an abutment 31. An adjusting screw 32 permits a slight adjustment of the angular position of the arm rest 29. However, the arm rests 29 can also be moved upward into a perpendicular position. This is important to permit a lateral transfer of the user from the chair into the bed and vice versa. A control organ 30 is provided. It may also have the function to control the tilt control actuator, e.g. a motor 33, for changing the inclination of the seat back 25. On the embodiment shown the tilt control motor 33 is a linear motor which at the bottom is pivotally connected at 34 at the support 21 and at the top with its push bar 35 at 36 to the seat back frame 13. It would also be possible to provide a manual tilt control device. Further, means 43 are provided which on a backward inclination of the seat back frame 13 move the back rest 25 down in direction to the tilting axis 11. A rope, a tape 43 or the like (partly shown in FIG. 1) serves to provide a mechanical connection from the support 21 via the connecting section 17 to the seat back carrier 44 of the seat back 25. As FIG. 2 shows, one end of the tape 43 is adjustably connected by a clamp 46 to the stationary part of the linear motor 33, whereas the other end of the tape 43 is connected to the seat back carrier 44. If, for increasing the inclination of the seat back 25, the push bar 35 of the linear motor 33 is moving downward the seat back 25 suspended on the tape 43 is also moving downward due to gravity. It would also be possible to move the seat back 25 forcibly for instance by having a tape from the lower part of the seat back carrier 44 via deflecting means to the push rod 35.

Further, a stabilizing mechanism 51 is provided which keeps the arm rests 29 in practically horizontal position independently from the inclination of the seat back 25. This stabilizing mechanism 51 has a lever arm 53 located at the arm rest 29 and being pivotally connected to one end of the connecting link 55. The other end of the connecting link 55 is pivotally connected at 56 to the seat back frame 13 by means of a vertically adjustable pipe clamp 60.

Figure 3A:
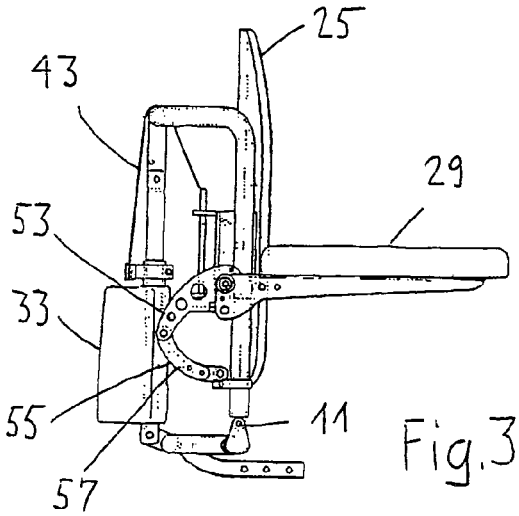
FIG. 3*a* to 3*c* shows a seat back unit according to FIGS. 1 and 2 at different inclined positions with the connection link to the arm rest being set to minimal length.
Figure 4A:
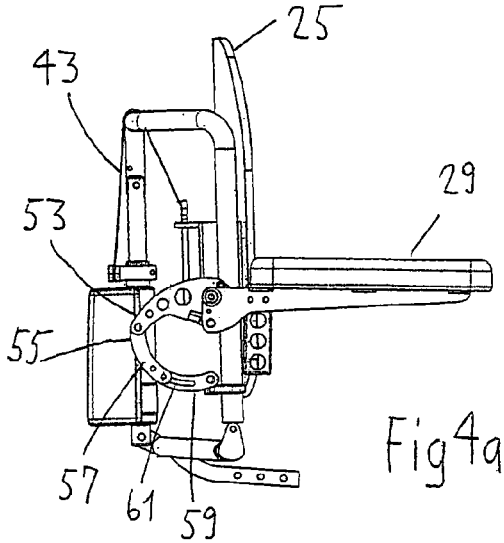
FIG. 4*a* to 4*c* show the seat back unit according to FIGS. 1 and 2 in different inclined positions with the connection link to the arm rest being set to maximal length.
Figure 3B:
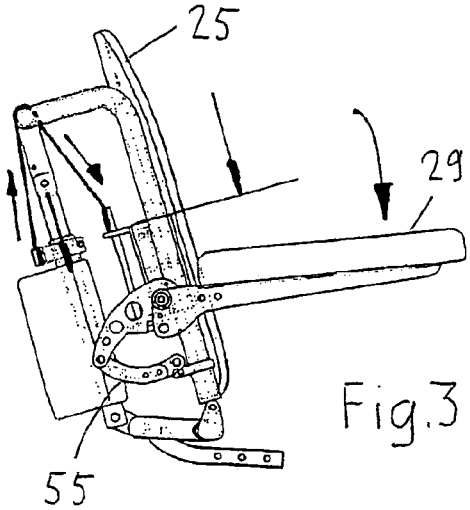
Figure 4B:
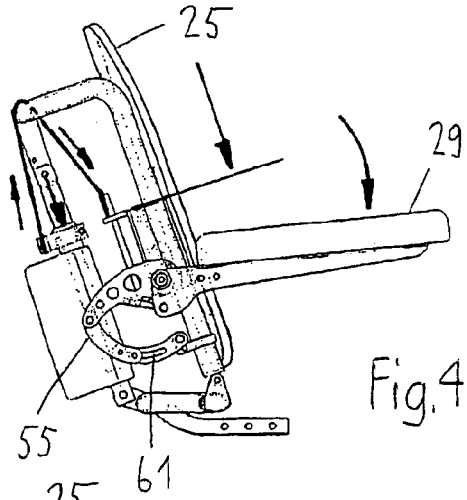
Figure 4C:
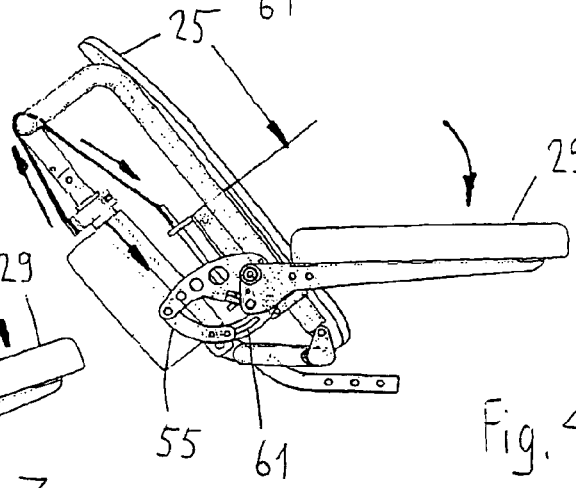
Figure 3C:
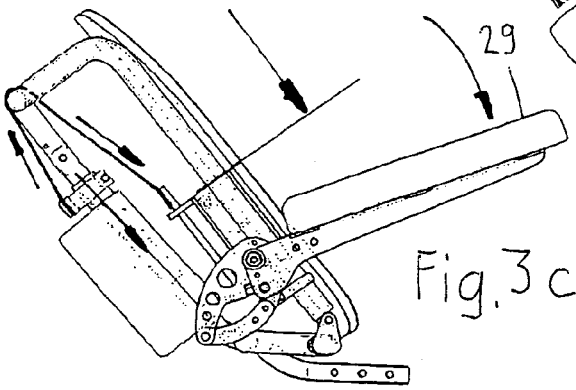

The length of the connection link 55 is adjustable. For this purpose it comprises two parts which are adjustably connected with screws (not shown). In order to elongate or shorten the connection link 55 the part 59 has a longitudinal slot 61. Depending on the length set of the connection link 55 the tilting behaviour of the back rest 25 will be different. The FIGS. 3*a* to 3*c* show different tilting angles when the connection link 55 is set at minimal length, and the FIGS. 4*a* to 4*c* show the different tilting angles when the connection link 55 is set at maximal length.

The arm rest 29 can be adjusted in height according to the stature of the user. If the arm rest 29 has to be elevated the clamp 46 is released, and by pulling the tape 43 the seat back carrier 44 together with the arm rests 29 are pulled upward, whereupon the clamp 46 is again fastened. Then, after releasing the pipe clamp 60 the pivot point 56 can be elevated and then locked at a higher elevation by tightening the pipe clamp.

Figure 5:
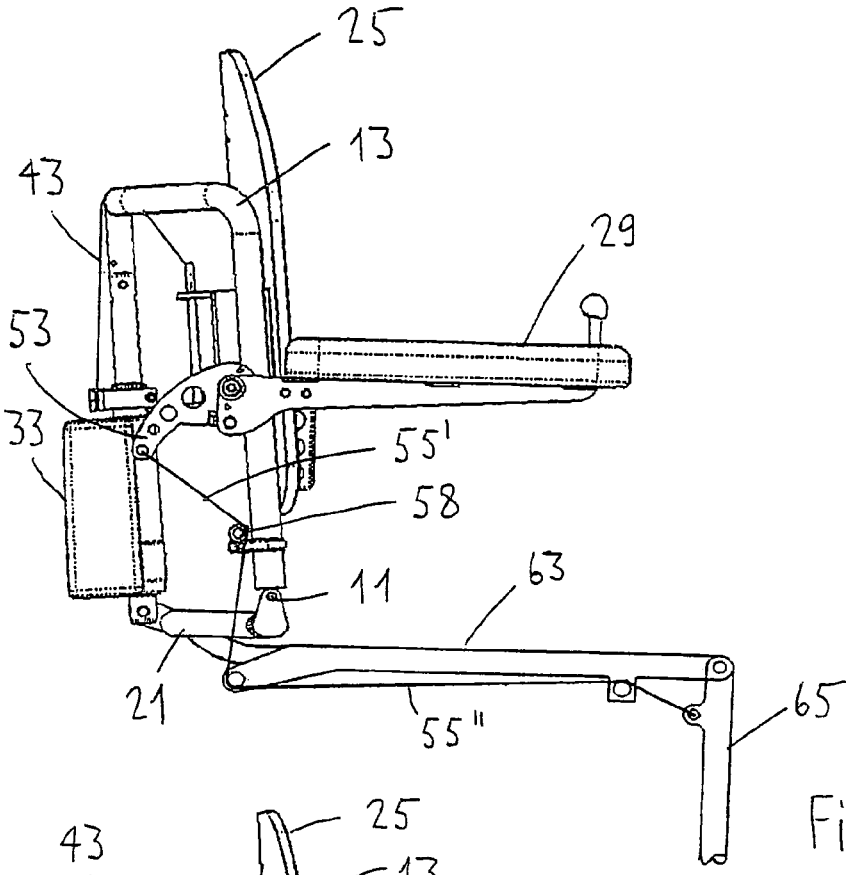
FIG. 5 shows the use of the seat back unit on a stand-up wheelchair shown schematically in the sitting position.
Figure 6:
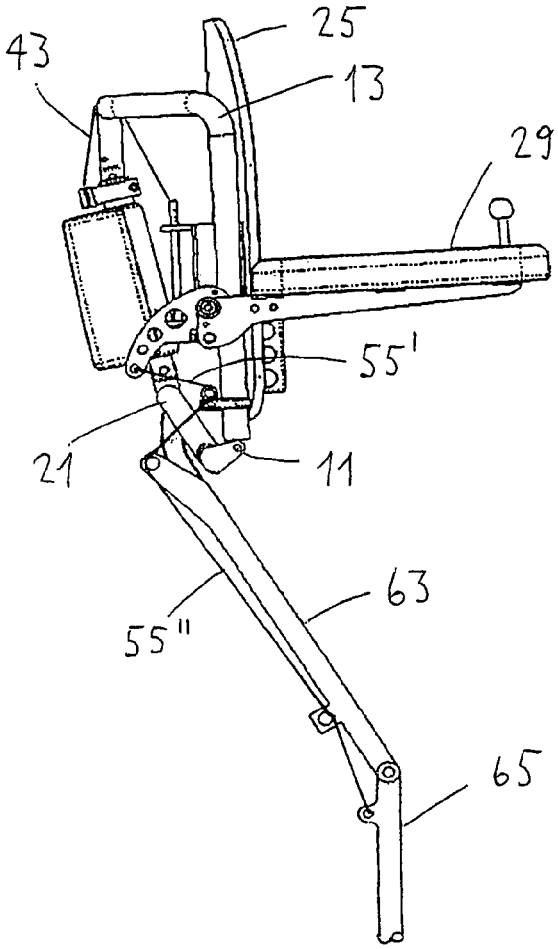
FIG. 6 shows the stand-up wheelchair according to FIG. 5 in erected position.

FIG. 5 shows another embodiment of the seat back unit and its use on a stand-up wheelchair. This embodiment differs from the earlier described embodiment in that the connection link 55 consisting of a stiff material is replaced by a length 55' of rope, tape or the like extending between the lever arm 53 and the roller 58. This length of rope 55' acts on tilting of the back rest 25 in the same way as previously described. In the upright position, as shown in FIG. 6, in which a change of the angle between the seat portion 63 and the foot rest 65 has taken place the pull on the second length of rope 55" keeps the arm rest 29 in the practically horizontal position. The two lengths of rope are in reality so designated sections of a single piece of rope.

What is claimed is:

1. A seat back unit for a wheel chair or a stand-up wheel chair, comprising:

a seat back frame tiltable around a tilting axis;

a seat back glideably mounted on the seat back frame;

arm rests pivotally attached to the seat back frame;

means for moving the seat back downward upon backward tilting of the seat back frame;

an actuator for changing the inclination of the seat back frame; and a stabilizing mechanism for each arm rest for keeping the arm rests substantially horizontal independent of the inclination of the seat back frame, each stabilizing mechanism comprising a lever arm connected to the arm rest and an adjustable connection link pivotally connected at one end to the lever arm and at another end to the seat back frame.

2. The seat back unit according to claim 1, wherein the seat back frame comprises two parallel columns pivotally connected to a support, the seat back comprises guiding means for gliding along the respective column, the actuator is pivotally connected to the support and to at least a section of the seat back frame.

3. The seat back unit according to claim 2, wherein the support comprises means for connecting the seat back unit to a chair.

4. The seat back unit according to claim 1, wherein the connection link comprises two adjustable parts releasably connected together.

5. The seat back unit according to claim 1, wherein the stabilizing mechanism comprises:

a lever arm connected to at least one of the arm rests; and connecting means for connecting the lever arm to a foot rest.

6. A seat back unit, comprising:

a seat back frame tiltable around a tilting axis;

a seat back moveably mounted to the seat back frame;

a pair of arm rests each pivotally attached to the seat back frame;

a mechanism coupled between the seat back and the seat back frame for moving the seat back upon tilting of the seat back frame;

an actuator coupled to the seat back frame for changing an inclination of the seat back frame; and a pair of stabilizing mechanisms, each stabilizing mechanism configured for keeping a respective one of said pair of arm rests substantially horizontally oriented independently of the inclination of the seat back frame, each of said pair of stabilizing mechanism comprising a lever arm connected to a respective one of said pair of arm rests and a first connection link connecting the lever arm with a foot rest.

7. The seat back unit of claim 6, wherein the seat back frame comprises two parallel columns pivotally connected to a support and the seat back comprises a pair of guiding portions for sliding along a respective column.

8. The seat back unit of claim 7, wherein the actuator is pivotally coupled to the support and to the seat back frame.

9. The seat back unit of claim 8, wherein the support comprises a connector for connecting the seat back unit to a chair.

10. The seat back unit of claim 6, wherein the pair of stabilizing mechanism each comprises;

a lever arm connected to one of the pair of arm rests; and a second connection link pivotally connected at one end to said lever arm and with the other end to the seat back frame.

11. The seat back unit of claim 10, wherein the length of the second connection link is adjustable.

12. The seat back unit of claim 11, wherein the connection second link comprises two adjustable parts releaseably connect together.

13. A seat back unit for a wheel chair or a stand-up wheel chair, comprising:

a seat back frame tiltable around a tilting axis;

a seat back glideably mounted on the seat back frame;

a pair of arm rests pivotally attached to the seat back frame;

a mechanism coupled between the seat back and the seat back frame for moving the seat back upon tilting of the seat back frame;

an actuator for changing the inclination of the seat back frame; and a stabilizing mechanism for each of said pair of arm rests for keeping the arm rests substantially horizontal independent of the inclination of the seat back frame, each stabilizing mechanism comprising a lever arm connected to the arm rest and an adjustable connection link pivotally connected at one end to the lever arm and at another end to the seat back frame.

14. The seat back unit of claim 13, wherein the seat back frame comprises two parallel columns pivotally connected to a support, the seat back comprises guiding portions each for gliding along one of the two parallel column, and the actuator is pivotally coupled between the support and the seat back frame.

15. The seat back unit of claim 14, wherein the support comprises means for connecting the seat back unit to a chair.

16. The seat back unit of claim 15, wherein the adjustable connection link comprises two adjustable parts releasably connected together.

17. The seat back unit of claim 15, wherein the stabilizing mechanism comprises a lever arm connected to at least one of the arm rests and connecting means for connecting the lever arm to a foot rest.

* * * * *